US006538611B2

(12) United States Patent
Noro

(10) Patent No.: US 6,538,611 B2
(45) Date of Patent: Mar. 25, 2003

(54) ANTENNA APPARATUS HAVING A SIMPLIFIED STRUCTURE

(75) Inventor: Junichi Noro, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 09/921,320

(22) Filed: Aug. 2, 2001

(65) Prior Publication Data

US 2002/0018026 A1 Feb. 14, 2002

(30) Foreign Application Priority Data

| | | |
|---|---|---|
| Aug. 2, 2000 | (JP) | 2000/234217 |
| Sep. 22, 2000 | (JP) | 2000/288593 |
| Jan. 10, 2001 | (JP) | 2001/002209 |
| Feb. 27, 2001 | (JP) | 2001/052378 |

(51) Int. Cl.[7] ..... H01Q 21/00; H01Q 1/36
(52) U.S. Cl. ..... 343/725; 343/895
(58) Field of Search ..... 343/725, 729, 343/895, 700 MS, 702

(56) References Cited

U.S. PATENT DOCUMENTS 5,831,577 A * 11/1998 Nichols et al. ..... 343/700 MS
5,910,790 A * 6/1999 Ohmuro et al. ..... 343/895
6,181,286 B1 * 2/2001 Roscoe et al. ..... 343/725
6,329,954 B1 * 12/2001 Fuchs et al. ..... 343/725

FOREIGN PATENT DOCUMENTS

| | | | |
|---|---|---|---|
| JP | 04-134906 | 5/1992 | ..... H01Q/5/00 |
| JP | 11-136021 | 5/1999 | ..... H01Q/11/08 |

* cited by examiner

*Primary Examiner*—Hoang Nguyen
(74) *Attorney, Agent, or Firm*—Frishauf, Holtz, Goodman & Chick, P.C.

(57) ABSTRACT

In an antenna apparatus, a first antenna and a second antenna for receiving radio waves different from each other are mounted to a single case or a single substrate. The first and the second antennas are connected through a common cable to a receiver body. The first antenna is a helical antenna and comprises an insulating cylindrical bobbin, a plurality of wires helically wound around the insulating cylindrical bobbin, and a ring-shaped insulating wire holder for fixing the wires to the insulating cylindrical bobbin. The second antenna is a monopole antenna and can be arranged inside the insulating cylindrical bobbin. The insulating cylindrical bobbin comprises a hollow center member having a center axis coincident with a center axis thereof so that the center axis of the monopole antenna is coincident with that of the helical antenna, and a rib supporting the hollow cylindrical member. The antenna apparatus has a top cover covering the antennas and provided with a protrusion for inhibiting the rotation of the ring-shaped insulating wire holder.

20 Claims, 18 Drawing Sheets

ANTENNA APPARATUS HAVING A SIMPLIFIED STRUCTURE

BACKGROUND OF THE INVENTION

This invention relates to an antenna apparatus for use in a digital radio receiver and, in particular, to an antenna apparatus for receiving both of a radio wave from an artificial satellite and a radio wave from a ground station.

At present, digital radio broadcasting (at a frequency of about 2.3 GHz) utilizing an artificial satellite (broadcasting satellite) is about to start in the United States of America. In this situation, development is made of digital radio receivers for receiving the digital radio broadcasting.

The digital radio receivers are classified into two types, one of which is adapted to directly receive a radio wave (may be called "satellite wave" hereinafter) transmitted from the artificial satellite and the other of which is adapted to receive a frequency-shifted radio wave (may be called "ground wave" hereinafter) broadcasted from a ground station where the radio wave from the artificial satellite is received and shifted in frequency to produce the frequency-shifted radio wave.

The digital radio receiver of the first type for directly receiving the satellite wave is intended to be mounted on a mobile body such as an automobile. Since the satellite wave is susceptible to the weather, it is desired that the digital radio receiver mounted on the mobile body can receive not only the satellite wave but also the ground wave.

However, the satellite wave is a circular polarized wave (or a circular polarization) while the ground wave is a linear polarized wave (or a polarization). Accordingly, in order to receive both of the satellite wave and the ground wave, special-purpose reception antennas are required to receive the satellite wave and the ground wave, respectively.

An existing satellite-wave antenna apparatus for receiving the satellite wave comprises an antenna such as a helical antenna, a low-noise amplifier connected to the antenna, and a case accommodating the antenna and the low-noise amplifier. Similarly, an existing ground-wave antenna apparatus for receiving the ground wave comprises an antenna such as a monopole antenna, a low-noise amplifier connected to the antenna, and a case accommodating the antenna and the low-noise amplifier.

Thus, the existing satellite-wave antenna apparatus and the ground-wave antenna apparatus are independent of each other. Therefore, a combination of the satellite-wave and the ground-wave antenna apparatuses requires a large number of components to be assembled and much labor and time in assembling these components. This inevitably results in an increase in cost. In addition, such combination of the satellite-wave and the ground-wave antenna apparatuses requires a large space for installation.

SUMMARY OF THE INVENTION

It is therefore an object of this invention to provide an antenna apparatus which is capable of receiving both a satellite wave and a ground wave and which has a simplified structure.

It is another object of this invention to provide an antenna apparatus which is capable of receiving both a satellite wave and a ground wave and which requires a less number of components and is easy in assembling.

It is still another object of this invention to provide an antenna apparatus which is capable of receiving both a satellite wave and a ground wave and which is small in size.

Other objects of this invention will become clear as the description proceeds.

According to a first aspect of this invention, an antenna apparatus comprises a plurality of antennas for individually receiving, as reception signals, radio waves different from one another in frequency and is connected to a receiver body. The antenna apparatus comprises a single case or a single substrate to which the antennas are mounted, and a single cable for transmitting to the receiver body a combined reception signal obtained by combining the reception signals received by the antennas.

According to a second aspect of this invention, an antenna apparatus comprises a helical antenna. The helical antenna comprises an insulating cylindrical bobbin, a wire helically wound around an outer peripheral surface of the cylindrical bobbin, and a plurality of ring-shaped insulating wire holders fitted to the cylindrical bobbin to fix the wire to the cylindrical bobbin.

According to a third aspect of this invention, the antenna apparatus comprises a helical antenna and a top cover. The helical antenna comprises a plurality of wire holders. An uppermost one of the wire holders has a recess or a cut formed at its outer peripheral portion. The top cover is provided with a protrusion to be engaged with the recess or the cut so as to inhibit the rotation of the uppermost wire holder in a circumferential direction of the helical antenna.

According to a fourth aspect of this invention, the antenna apparatus comprises a plurality of antennas each of which is provided with a boss pin formed at its lower end, and a case or a substrate to which the antennas are mounted. The boss pin is inserted into a hole formed in the case or the substrate and is fused to the case or the substrate.

According to a fifth aspect of this invention, the antenna apparatus comprises a helical antenna having a cylindrical bobbin, and a monopole antenna arranged inside the cylindrical bobbin. The cylindrical bobbin comprises an outer cylindrical member, a hollow center member having a center axis coincident with that of the outer cylindrical member and adapted to receive the monopole antenna to be inserted therein, and at least three ribs radially extending from the center member to the outer cylindrical member to connect the center member and the outer cylindrical member. The outer cylindrical member, the center member, and the ribs are integrally formed.

DESCRIPTION OF THE EMBODIMENTS

Figure 1:
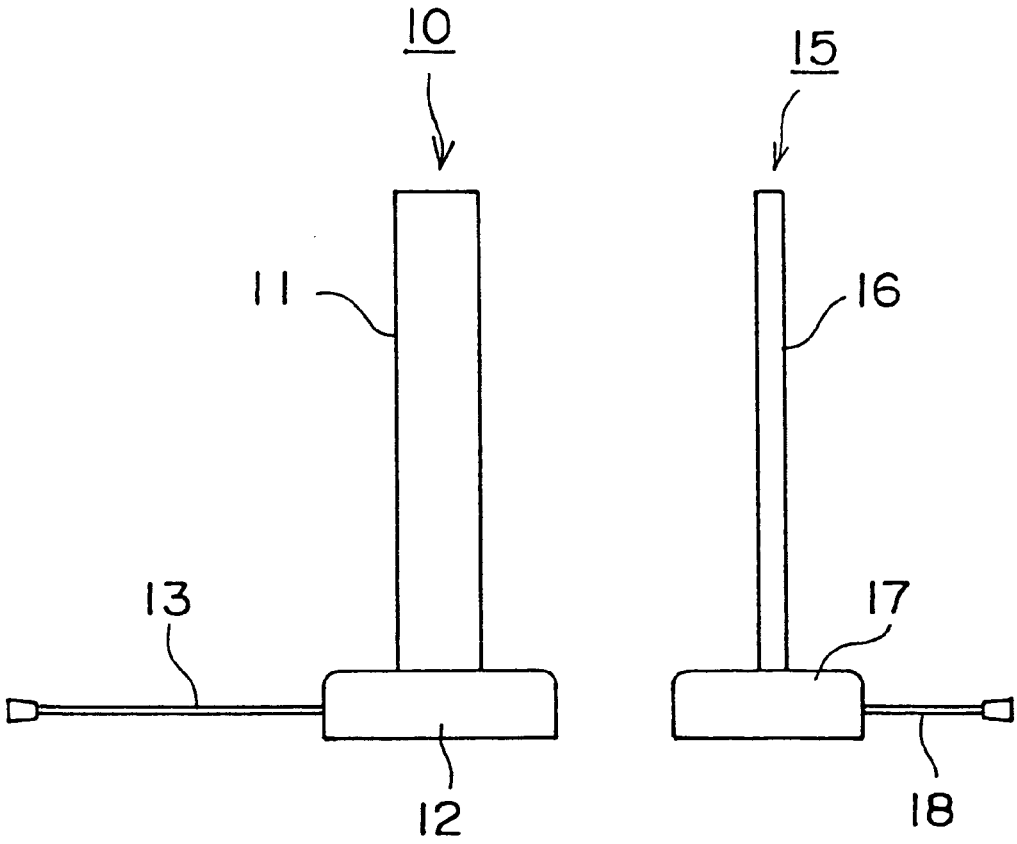
FIG. 1 (PRIOR ART)
FIG. 1 is a side view of an existing antenna apparatus.

In order to facilitate an understanding of this invention, description will at first be made of existing antenna apparatuses with reference to the drawing.

At first referring to FIG. 1, an existing antenna apparatus is used in an in-vehicle digital radio receiver for receiving both a satellite wave and a ground wave and comprises a first antenna unit 10 for receiving a satellite wave and a second antenna unit 15 for receiving a ground wave.

The first antenna unit 10 comprises a first antenna 11 for receiving the satellite wave, a first case 12 to which the first antenna 11 is mounted and fixed, a first circuit (not shown) accommodated in the first case 12, and a first cable 13 connected to the first circuit.

The second antenna unit 15 is independent of the first antenna unit 10. The second antenna unit 15 comprises a second antenna 16 for receiving the ground wave, a second case 17 to which the second antenna 16 is mounted and fixed, a second circuit (not shown) accommodated in the second case 17, and a second cable 18 connected to the second circuit In the first antenna unit 10, the first antenna 11 receives the satellite wave and produces a plurality of reception signals. For example, if the first antenna 11 is a four-phase feed helical antenna, the first antenna 11 produces four reception signals. The first circuit comprises a phase shifter, a combiner, and a low-noise amplifier (LNA). The phase shifter serves to adjust or control phases of the reception signals from the first antenna 11 so as to match the phases with one another, and produces phase-controlled reception signals. The combiner combines the phase-controlled reception signals to produce a combined reception signal. The low-noise amplifier amplifies the combined reception signal to produce an amplified reception signal which is transmitted through the cable 13 to a receiver body.

In the second antenna unit 15, the second antenna 16 receives the ground wave and produces a reception signal. The reception signal is amplified by the low-noise amplifier contained in the second circuit and transmitted through the cable 18 to the receiver body.

As described above, the existing antenna apparatus comprises the first and the second antenna units each of which includes the antenna, the case, and the cable. Thus, the existing antenna apparatus is disadvantageous in that a large number of components are included and much time and labor are required for manufacture and assembling.

In order to remove the above-mentioned disadvantage, it is proposed to form an integral structure of the first and the second antenna units. Actually, an antenna apparatus comprising a helical antenna and a monopole antenna in such an integral structure is disclosed in JP 4-134906 A and JP 11-136021 A.

Figure 2A:
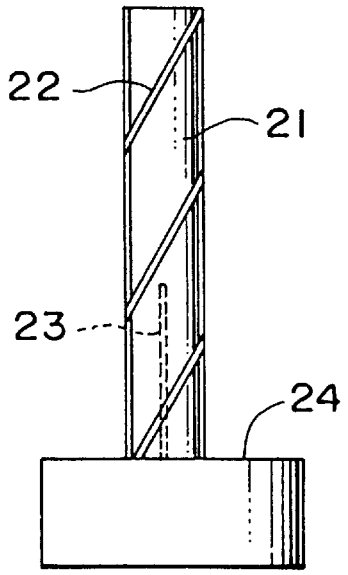
FIG. 2A (PRIOR ART)
FIG. 2A is a side view of another existing antenna apparatus comprising a helical antenna and a monopole antenna in an integral structure.
Figure 2B:
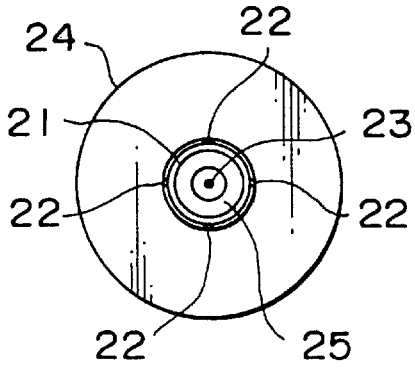
FIG. 2B (PRIOR ART)
FIG. 2B is a plan view of the antenna apparatus illustrated in FIG. 2A.

Referring to FIGS. 2A and 2B, description will be made of an antenna apparatus comprising a helical antenna and a monopole antenna in an integral structure.

The antenna apparatus comprises, as the helical antenna, a combination of an insulating cylindrical member 21 made of plastic and a plurality of conductor wires 22 helically wound around the cylindrical member 21, and a monopole antenna 23 arranged inside the cylindrical member 21. The helical antenna and the monopole antenna 23 are fixed to a receiver body 24.

The monopole antenna 23 must have a center axis substantially coincident with that of the cylindrical member 22 so as to stabilize its directional characteristics. In order to coincide the center axis of the monopole antenna 23 to that of the cylindrical member 22, the cylindrical member II is provided with an antenna holder 25 arranged inside, as illustrated in FIG. 2B.

The antenna holder 25 has a ring shape or a hollow cylindrical shape. The monopole antenna 23 is inserted into a hollow portion of the antenna holder 25.

The above-mentioned antenna apparatus is small in size because the helical antenna and the monopole antenna are integral with each other. However, the antenna apparatus requires the antenna holder 25 separate from the cylindrical member 11. Thus, an increased number of components is required and assembling is troublesome.

Furthermore, the helical antenna used in the existing antenna apparatus has following disadvantages.

Generally, in order to improve the gain of the helical antenna, the number of turns of the conductor wire helically wound around must be increased. However, in order to increase the number of turns of the conductor wire, the helical antenna must be increased in length. Such increase in length is unfavorable. Therefore, in order to increase the gain of the helical antenna without increasing the length of the helical antenna, a plurality of conductor wires are used.

The conductor wires are wound around the insulating cylindrical member at a predetermined interval from one another. Each conductor wire serves as an antenna element.

The reception signals received by the conductor wires are combined after matching the phases thereof. Thus, an effect similar to that achieved by the increase in number of turns of a single conductor wire can be obtained by the use of a plurality of the conductor wires without increasing the length of the helical antenna.

Actually, however, it is very difficult to wind a plurality of the conductor wires around the insulating cylindrical member at equal intervals. In view of the above, the existing helical antenna uses an insulating film with a plurality of conductor patterns are printed thereon. Specifically, the existing helical antenna comprises the insulating film having a plurality of the conductor patterns printed thereon and wound around the insulating cylindrical member. When the insulating film is wound around the insulating cylindrical member, a plurality of the conductor patterns are wound around the insulating cylindrical member.

As described above, the existing helical antenna comprises the insulating film with the conductor patterns printed thereon. As the insulating film, use may be made of, for example, a flexible substrate made of polyimide which is, however, expensive. In addition, the formation of the conductor patterns on the insulating film requires much time and labor. Furthermore, each of the conductor patterns printed on the insulating film is divided into a plurality of parts. It is difficult to wind the insulating film around the insulating cylindrical member so that the plurality of parts are accurately connected.

Now, referring to FIGS. 3 and 4, description will be made of an antenna apparatus according to a first embodiment of this invention.

Figure 3:
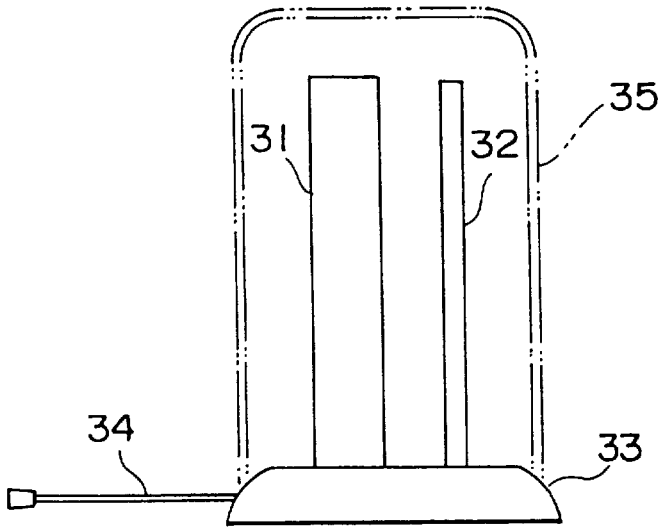
FIG. 3 is a side view of an antenna apparatus according to a first embodiment of this invention.

As illustrated in FIG. 3, the antenna apparatus comprises first and second antennas 31 and 32 for individually receiving as reception signals radio waves different from each other, a case 33 to which the first and the second antennas 31 and 32 are mounted and fixed, a signal processing circuit (see FIG. 4) accommodated in the case 33 for combining the reception signals from the first and the second antennas 31 and 32 to produce a processed reception signal, and a cable 34 connected to the signal processing circuit for transmitting the processed reception signal to a receiver body (not shown). The antenna apparatus further comprises a top cover 35 for covering the first and the second antennas 31 and 32. The top cover 35 is made of a material allowing the radio waves to pass therethrough.

Figure 4:
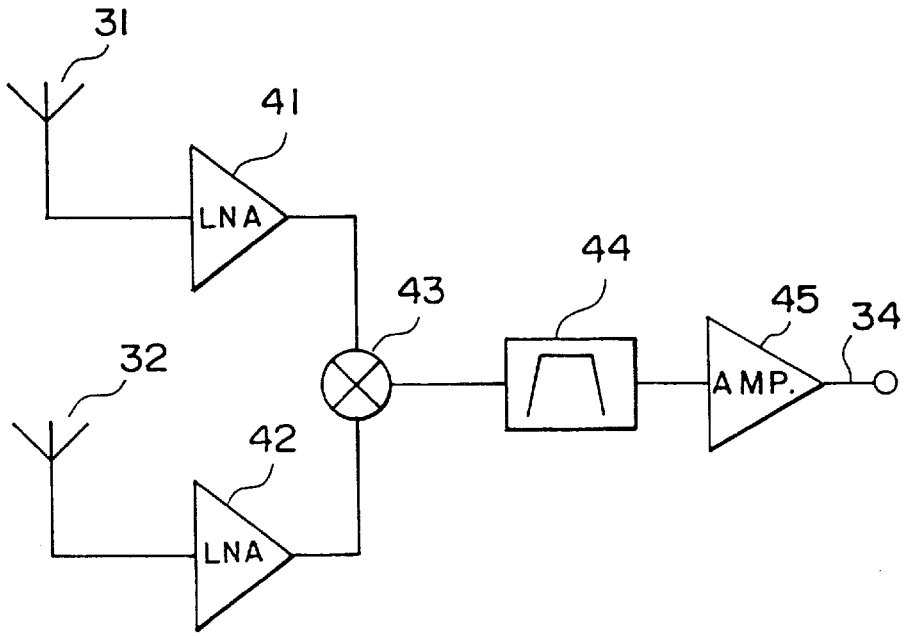
FIG. 4 is a circuit diagram of the antenna apparatus illustrated in FIG. 3.

As illustrated in FIG. 4, the signal processing circuit comprises first and second low-noise amplifiers (LNA) 41 and 42 connected to the first and the second antennas 31 and 32, respectively, a combiner 43 for combining outputs of the first and the second low-noise amplifiers 41 and 42, a band-pass filter 44, and an amplifier 45. The signal processing circuit also includes a phase shifter (not shown) and a mode converter such as a balun.

The first and the second antennas 31 and 32 receive predetermined radio waves and produce the reception signals, respectively. The first and the second low-noise amplifiers 41 and 42 amplify the reception signals supplied from the first and the second antennas 31 and 32 to produce amplified reception signals. The combiner 43 combines the amplified reception signals from the first and the second low-noise amplifiers 41 and 42 into an amplified combined reception signal. At this time, the phase shifter (not shown) phase-matches the amplified reception signals from the first and the second low-noise amplifiers 41 and 42. The band-pass filter 44 filters the amplified combined reception signal to produce a filtered combined reception signal. The amplifier 45 amplifies the filtered combined reception signal to produce the processed reception signal which is delivered through the cable 34 to the receiver body.

According to this embodiment, the single case is shared by the two antennas. Therefore, reduction in number of components is achieved. As a consequence, the assembling process is simplified.

In this embodiment, existing antennas can be used as the first and the second antennas. Thus, reduction in size can be achieved without using any special antennas.

In this embodiment, the single case is shared by the two antennas. It is noted here that the signal case may be shared by three or more antennas.

The signal processing circuit may have another structure without the combiner 43. For example, the filter 44 is directly connected to the low-noise amplifier 41 while another amplifier is connected to the low-noise amplifier 42 through another band-pass filter.

Next referring to FIGS. 5A through 5C, description will be made of an antenna apparatus according to a second embodiment of this invention.

Figure 5A:
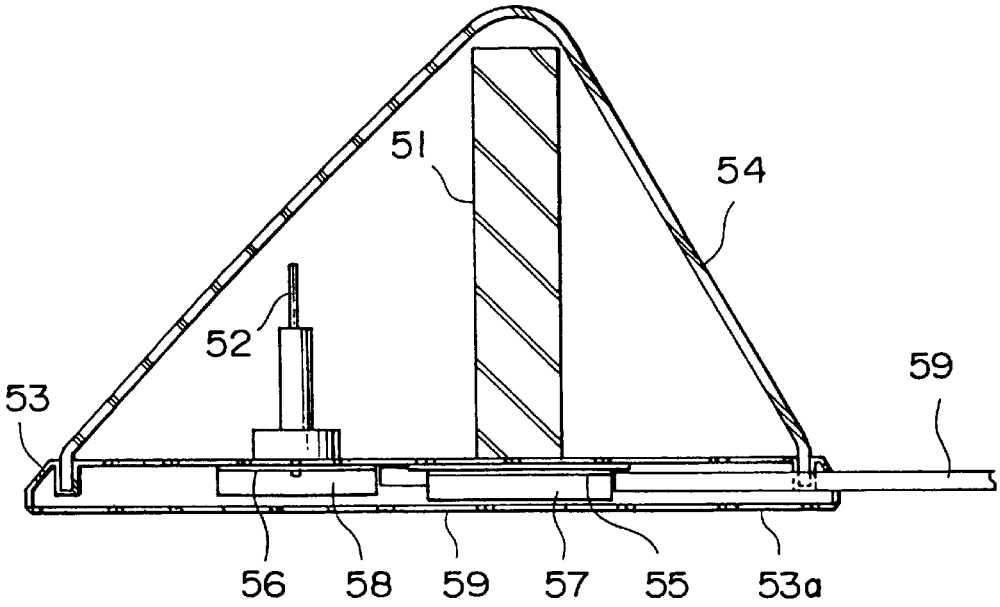
FIG. 5A is a partially-sectional side view of an antenna apparatus according to a second embodiment of this invention.
Figure 5B:
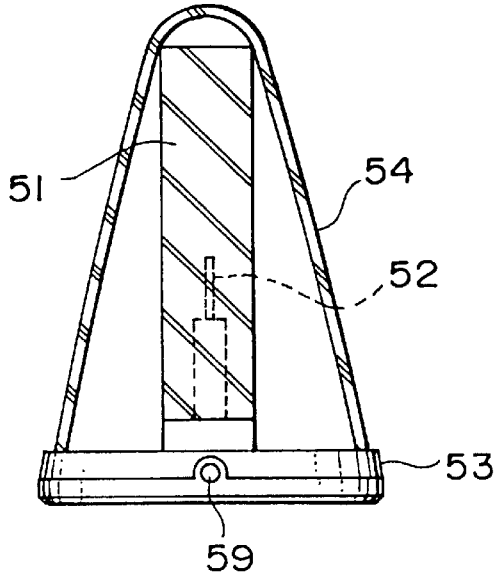
FIG. 5B is a partially-sectional front view of the antenna apparatus illustrated in FIG. 5A.
Figure 5C:
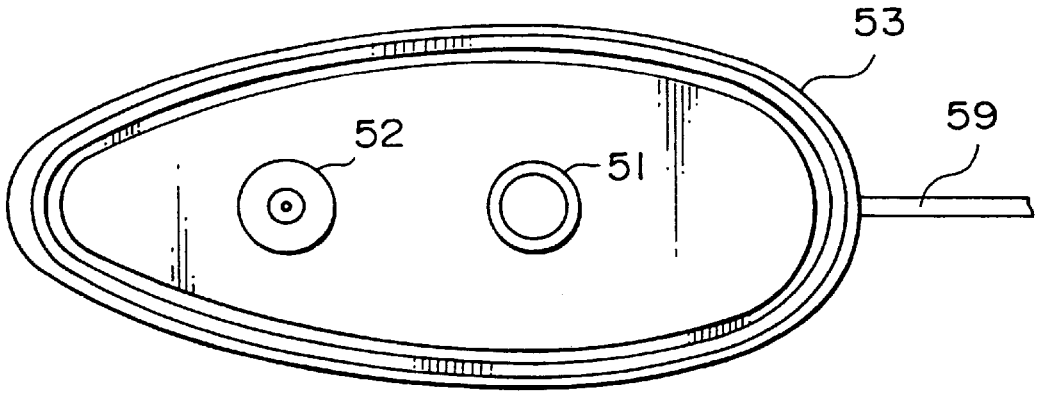
FIG. 5C is a plan view of the antenna apparatus illustrated in FIG. 5A with a top cover omitted therefrom.

As illustrated in FIGS. 5A through 5C, the antenna apparatus comprises a helical antenna 51 for receiving a satellite wave (circular polarized wave), a monopole antenna for receiving a ground wave (linear polarized wave), a case 53 to which the helical antenna 51 and the monopole antenna 52 are mounted and fixed, and a top cover 54 having a cap-like shape and covering the helical antenna 51 and the monopole antenna 52.

The antenna apparatus further comprises, inside the case 53, a first low-noise amplifier 55 connected to the helical antenna 51, a second low-noise amplifier 56 connected to the monopole antenna 52, first and second shield covers 57 and 58 arranged on lower surfaces of the first and the second low-noise amplifiers 55 and 56, respectively, a combiner (not shown) for combining amplified signals from the first and the second low-noise amplifiers 55 and 56, and a cable 59 connected to the combiner.

The helical antenna 51 comprises a cylindrical member of an insulating plastic material, and a plurality of conductor wires helically wound around the cylindrical member. The conductor wires are wound around the cylindrical member so as to receive the satellite wave, i.e., a left-handed circular polarized wave. The conductor wires are connected to another phase shifter (not shown). Reception signals received by the conductor wires are adjusted and controlled in phase and thereafter combined into a combined reception signal. The combined reception signal is supplied to the first low-noise amplifier 55 and amplified into the amplified signal.

The monopole antenna 52 is adapted to receive the ground wave, i.e., the linear polarized wave. The monopole antenna 52 comprises a rod-like conductor and a base portion made of an insulating plastic material for holding the rod-like conductor in a vertically standing position. A reception signal received by the rod-like conductor is supplied to the second low-noise amplifier 55 and amplified into the amplified signal.

Each of the case 53 and the top cover 54 is made of a material allowing the radio waves to pass therethrough. The case 53 has a plurality of holes for receiving a plurality of protrusions formed at an opening end of the top cover 54. The top cover 54 is fixed on the case 53 by Inserting the protrusions into the holes formed in the case 53.

The amplified signals produced from the first and the second low-noise amplifiers 55 and 56 are matched in phase with each other and thereafter combined by the combiner into a combined reception signal which is sent through the cable 59 to a receiver body.

The first and the second shield covers 57 and 58 serve to shield the radio waves traveling from a bottom plate 53*a* of the case 53 towards the helical antenna 51 and the monopole antenna 52. The first shield cover 57 extends within a plane perpendicular to a center axis of the helical antenna 51 in a direction away from the center axis. Similarly, the second shield cover 58 extends within a plane perpendicular to a center axis of the monopole antenna 52 in a direction away from the center axis.

In this embodiment, the single case is shared by the two antennas. Therefore, reduction in number of components is achieved. As a consequence, the assembling process is simplified.

In this embodiment, an existing helical antenna and an existing monopole antenna can be used as they are. Thus, reduction in size can be achieved without using any special antennas.

In this embodiment, the single case is shared by the two antennas. It is noted here that the signal case may be shared by three or more antennas.

Next referring to FIGS. 6 through 11, description will be made of an antenna apparatus according to a third embodiment of this invention.

Figure 6:
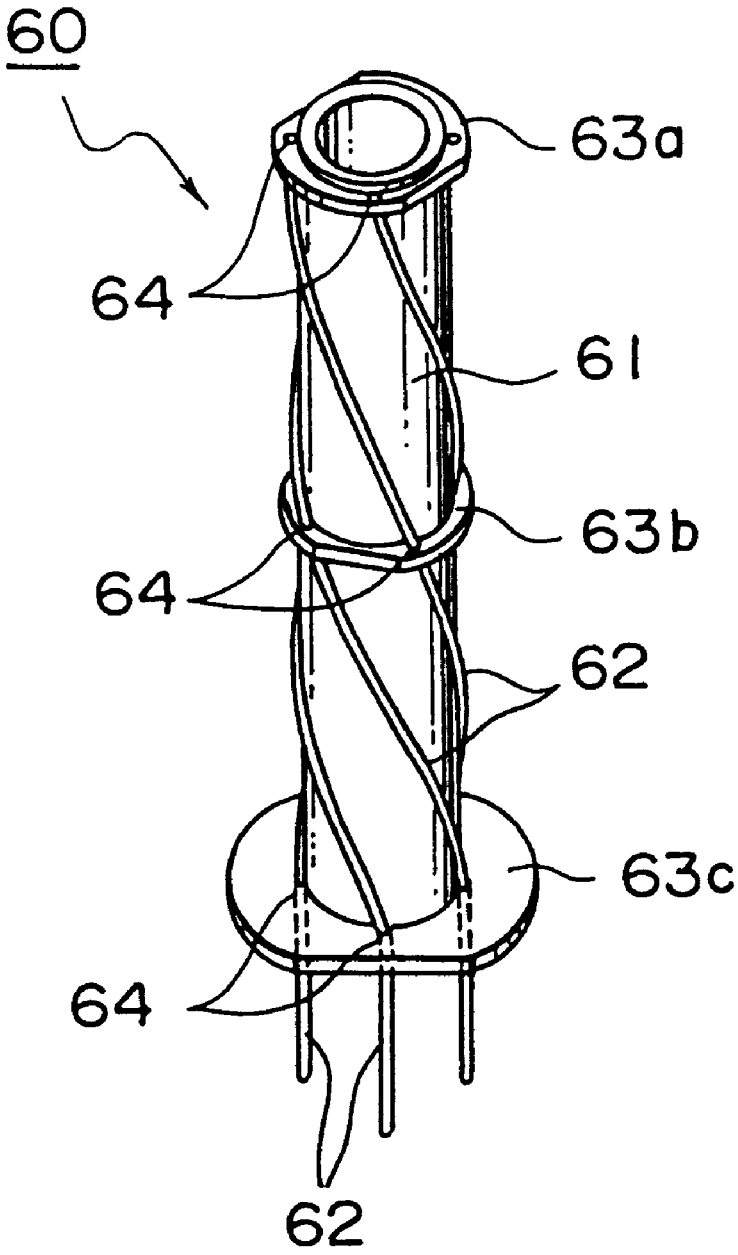
FIG. 6 is a perspective view of a helical antenna used in an antenna apparatus according to a third embodiment of this invention.

Referring to FIG. 6, a helical antenna (four-phase feed helical antenna) 60 used in the antenna apparatus comprises a cylindrical member 61 made of an insulating resin material and having an outer diameter of about 1.2 mm, four copper wires 62 each of which has a thickness between 0.5 and 1.2 mm and is helically wound around an outer peripheral surface of the cylindrical member 61, and three wire holders 63*a*, 63*b*, and 63*c* made of an insulating resin material for fixing the copper wires 62 to the cylindrical member 61.

Each of the wire holders 63*a* through 63*c* has an inner diameter substantially equal to or slightly smaller than the outer diameter of the cylindrical member 61. Applied with an external force not smaller than a predetermined force, the wire holders 63*a* through 63*c* rotate with respect to the cylindrical member 61. In absence of the external force, the wire holders 63*a* through 63*c* are fixed to the cylindrical member 61 under frictional force. At or near the inner periphery of each of the wire holders 63*a* through 63*c*, four notches or holes 64 are formed at positions where the inner periphery is quartered. These notches or holes 64 serve to engage the copper wires 62, respectively.

Figures 9A, 9B:
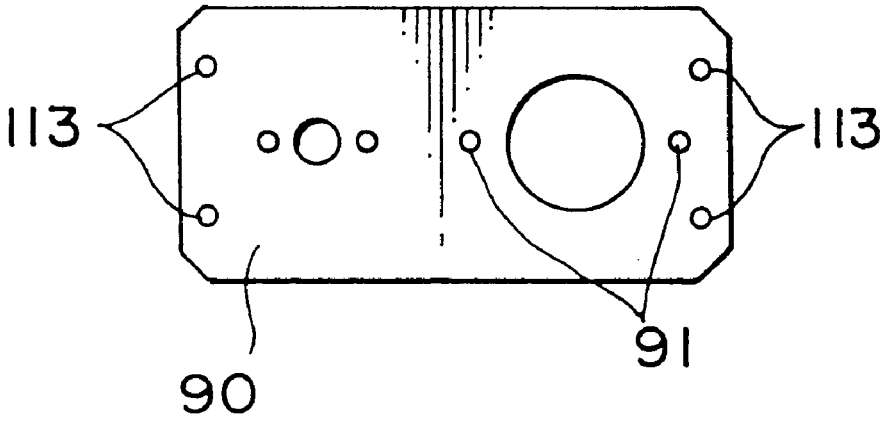
FIG. 9A is a side view of a ground plate to which the helical antenna of FIG. 6 is mounted.
FIG. 9B is a plan view of the ground plate illustrated in FIG. 9A.

Among the wire holders 63*a* through 63*c*, the lowermost wire holder 63*c* is used as a fixing portion when the helical antenna is later attached to a ground plate (see FIGS. 9A and 9B). For this purpose, the wire holder 63*c* is greater than the remaining wire holders 13*a* and 13*b*.

Next referring to FIGS. 7A and 7B, description will be made of a method of producing the helical antenna illustrated in FIG. 6.

Figure 7A:
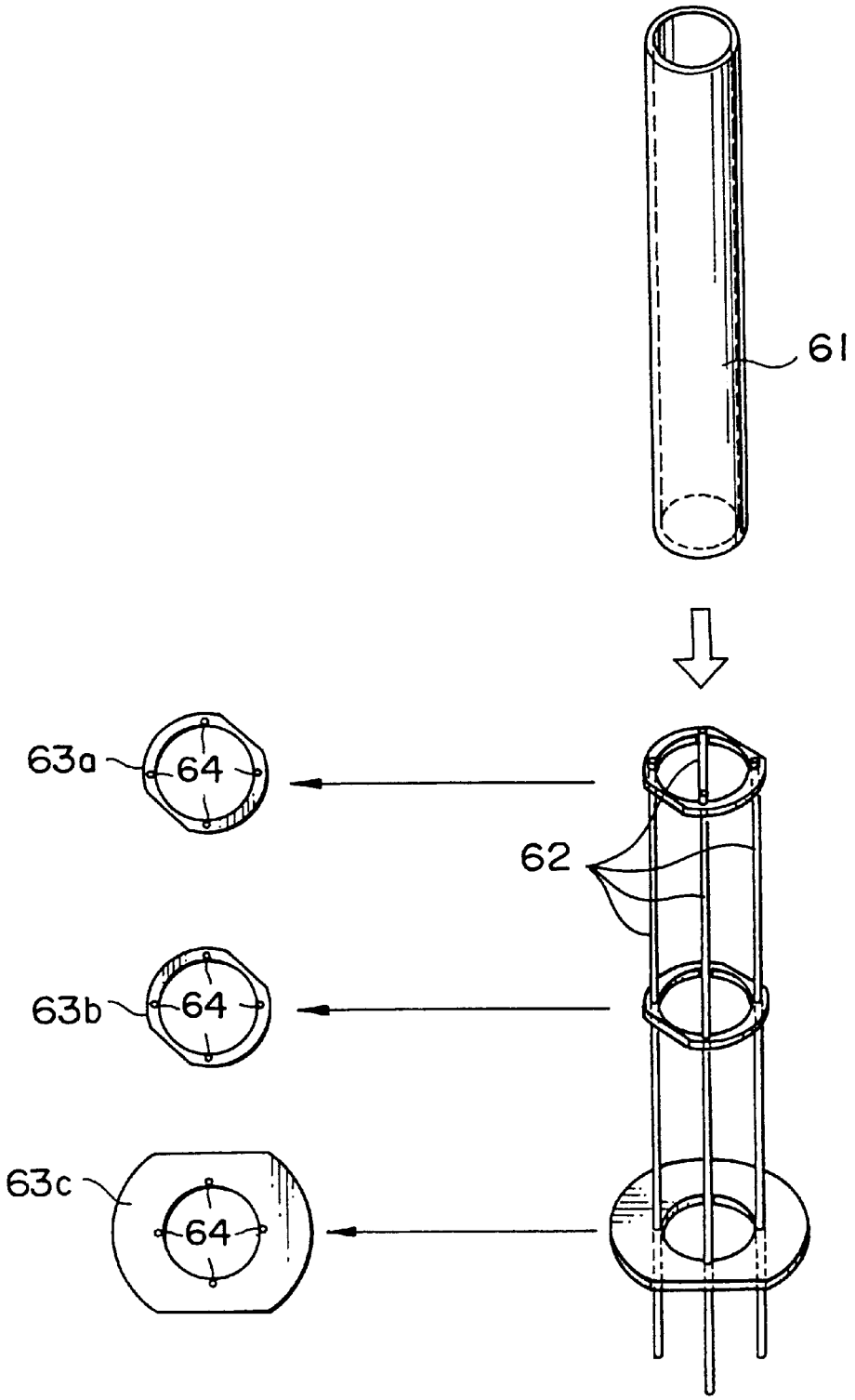
FIGS. 7A and 7B are views for describing an assembling process of the helical antenna illustrated in FIG. 6.

At first, as illustrated on a lower right side in FIG. 7A, the four linear copper wires 62 are held by the notches 64 formed at the inner peripheries of the wire holders 63*a* through 63*c*. As illustrated on a lower left side in FIG. 7A, each notch 64 has a circular or a generally circular shape (similar to a sectional shape of the copper wire 62). Therefore, the copper wires 62 are fixed with respect to a radial direction. This step may be carried out in the manner such that the wire holders 63*a* through 63*c* are fitted to the copper wire 62 or that the copper wires 62 are fitted to the wire holders 63*a* through 63*c*. In other words, the four copper wires 62 are fixed by a fixture (not shown) and then the wire holders 63*a* through 63*c* are attached to predetermined positions of the wires 62. On the contrary, the wire holders 63*a* through 63*c* are fixed at predetermined intervals and then the wires 62 are fitted to the wire holders 63*a* through 63*c*.

Figure 7B:
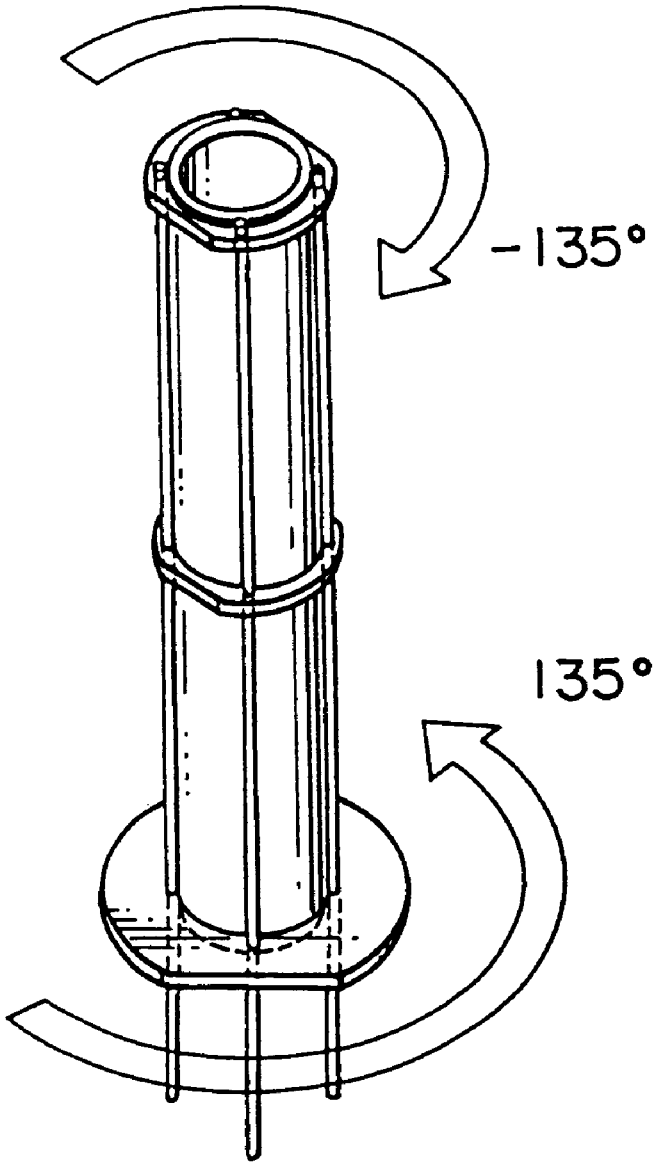

Next, the cylindrical member 61 is fitted or inserted from the above into the wire holders 63*a* through 63*c* with the wires 62 attached thereto, as illustrated in FIG. 7B. As described above, each of the wire holders 63*a* through 63*c* has the inner diameter substantially similar to or slightly smaller than the outer diameter of the cylindrical member 61 so that the inner peripheries of the wire holders 63*a* through 63*c* are brought into tight contact with the outer peripheral surface of the cylindrical member 61. As a consequence, the wire holders 63*a* through 63*c* are fixed or secured to the cylindrical member 61 by frictional force. However, if an external force exceeding the frictional force is applied, the wire holders 63*a* through 63*c* can rotate and/or move with respect to the cylindrical member 61.

Then, one of the three wire holders 63*a* through 63*c* is fixed to the cylindrical member 61 while the remaining two are rotated in a circumferential direction of the cylindrical member 61 by a predetermined angle. For example, the center wire holder 63*b* is held and fixed by a holder (not shown) while the uppermost and the lowermost wire holder 63*a* and 63*c* are rotated by 135° clockwise and 135° counterclockwise, respectively. Alternatively, the lowermost wire holder 63*c* is fixed while the center wire holder 63*b* and the uppermost wire holder 63*a* are rotated by 135° clockwise and 270° clockwise, respectively.

As described above, the helical antenna illustrated in FIG. 6 can be produced. The helical antenna does not require a polyimide insulating film which is expensive. Furthermore, the helical antenna does not require a conductor pattern forming process which is complicated. Therefore, the helical antenna is advantageous in that the production process is simplified and the cost is reduced.

Figure 8A:
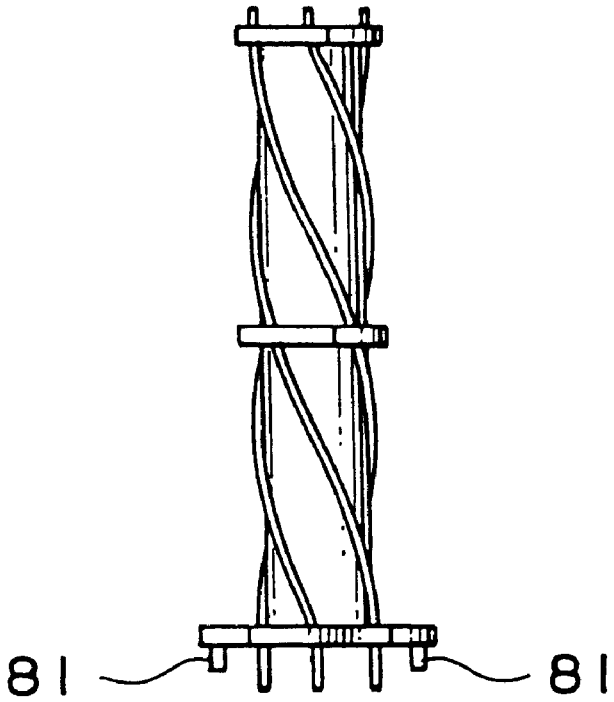
FIGS. 8A and 8B are side and bottom views, respectively, of the helical antenna illustrated in FIG. 6.
Figure 8B:
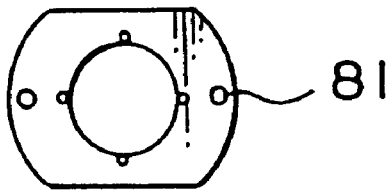
Figure 10:
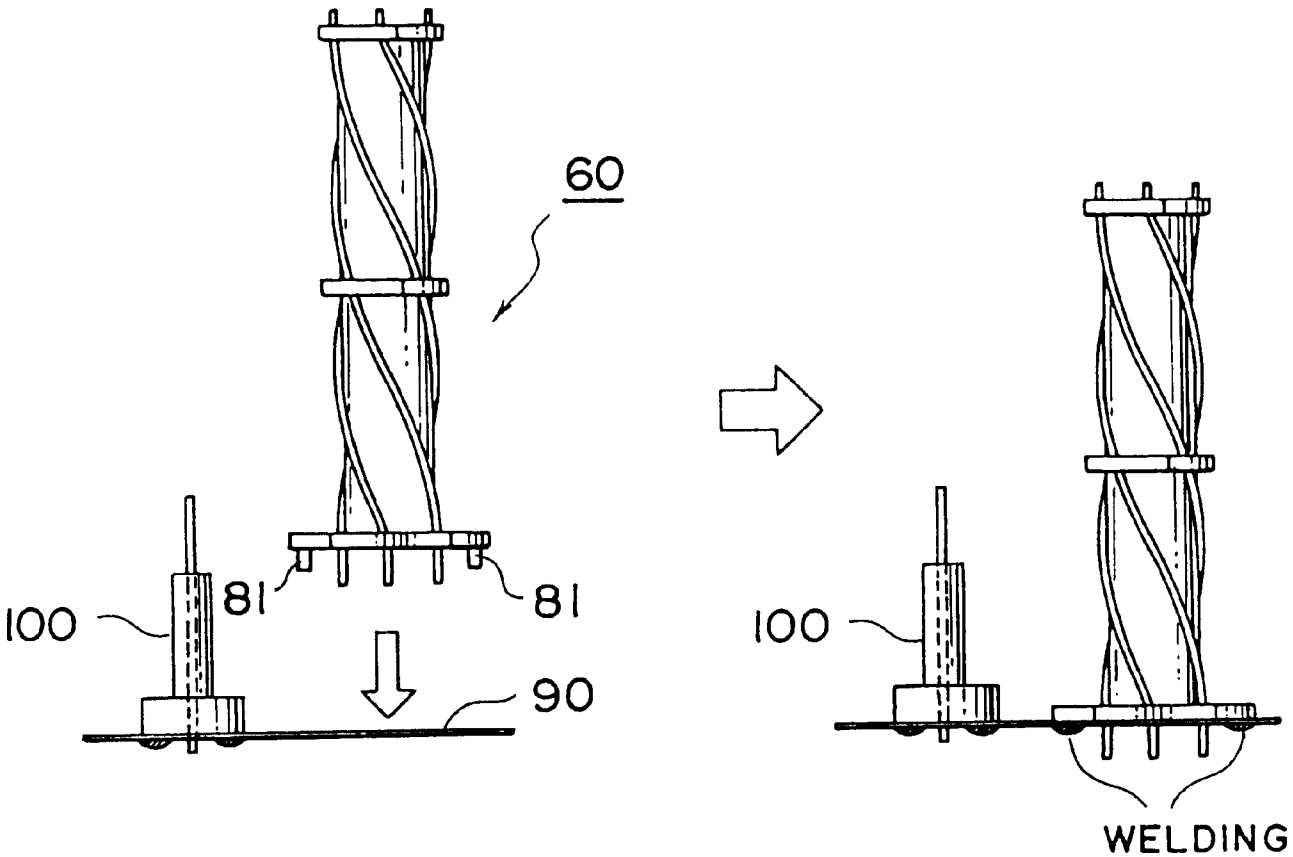
FIG. 10 is a view for describing a step of mounting the helical antenna in FIG. 6 onto the ground plate illustrated in FIGS. 9A and 9B.

As illustrated in FIGS. 8A and 8B, the above-mentioned helical antenna has fusing boss pins 81 formed on a lower surface of the lowermost wire holder 63*c*. The fusing boss pins 81 are inserted into boss pin holes 91 formed on a ground plate (GND plate) 90 illustrated in FIGS. 9A and 9B from the side of an upper surface of the ground plate 90. The boss pins 81 inserted into the boss pin holes 91 are fused to a lower surface of the ground plate 90. Thus, as illustrated in FIG. 10, the helical antenna 60 is mounted on the ground plate 90 in the manner such that the fusing boss pins 81 are inserted into the boss pin holes 91 of the ground plate 90. The boss pins 81 are fused to the ground plate 90. In FIG. 10, a monopole antenna 100 is also mounted on the ground plate 90 to receive the ground wave (linear polarized wave). Like the helical antenna 60, the monopole antenna 100 is fixed to Fe ground plate 90 by fusing boss pins inserted into boss pin holes formed on the ground plate 90 and fused to the ground plate 90.

Figure 11:
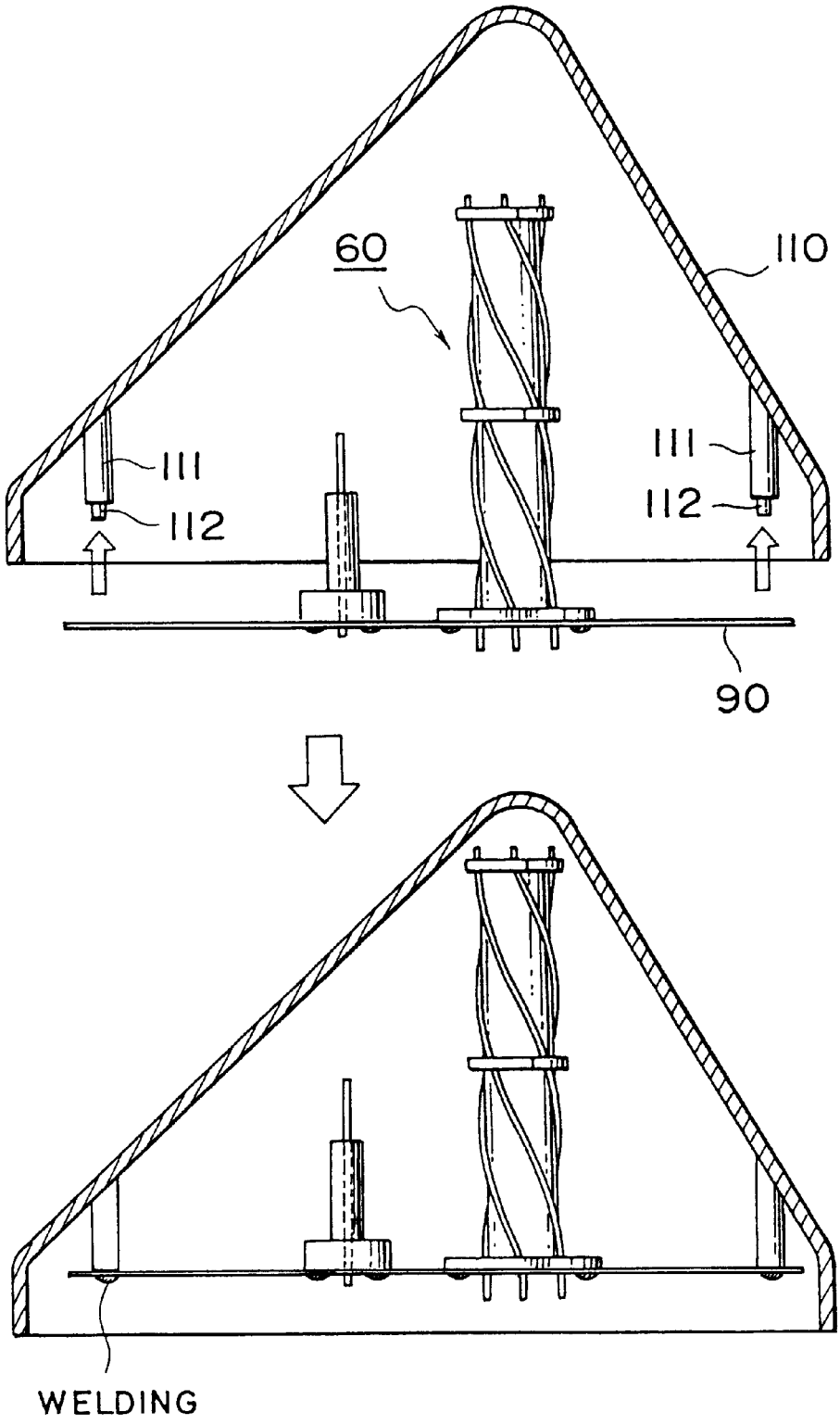
FIG. 11 is a view for describing a step of attaching a top cover to the ground plate with the helical antenna mounted thereon as illustrated in FIG. 10.

As illustrated in FIG. 11, a top cover 110 is attached to the ground plate 90 with the helical antenna 60 mounted thereon so as to cover the helical antenna 60. The top cover 110 has legs 111 for attachment of the ground plate 90. The legs 111 are provided with fusing boss pins 112 formed at their ends, respectively. On the other hand, the ground plate 90 is provided with boss pin holes (113 in FIG. 9B) corresponding to the fusing boss pins 112. The fusing boss pins 112 are inserted into the boss pin holes 113 corresponding thereto and fused to the ground plate 90 on the lower surface of the ground plate 90.

As described above, the helical antenna 60 is mounted on the ground plate 90 and covered with the top cover 110. Thus, the antenna apparatus is formed.

In this embodiment, the wires.are attached to the insulating cylindrical member by the use of the wire holders. The wire holders are rotated with respect to the cylindrical member to thereby wound the wires in a helical fashion. Thus, the production process is simplified and the production cost is reduced.

In this embodiment, no fitting screw is used to attach the helical antenna 60 and the top cover 110 to the ground plate 90. Therefore, it is possible to reduce the number of components and to reduce the cost.

In the above-mentioned embodiment, the cylindrical member and the wire holders are separately produced. Alternatively, one of the wire holders may be integrally formed with the cylindrical member. In this event, the remaining wire holders are rotated to thereby wound the wires in a helical fashion.

In the foregoing embodiment, the copper wires are used. Alternatively, other metal wires may be used.

In the foregoing embodiment, the helical antenna has four copper wires. However, the number of wires may be any number not smaller than 1.

Next referring to FIGS. 12 through 15, description will be made of an antenna apparatus according to a fourth embodiment of this invention.

Figure 12:
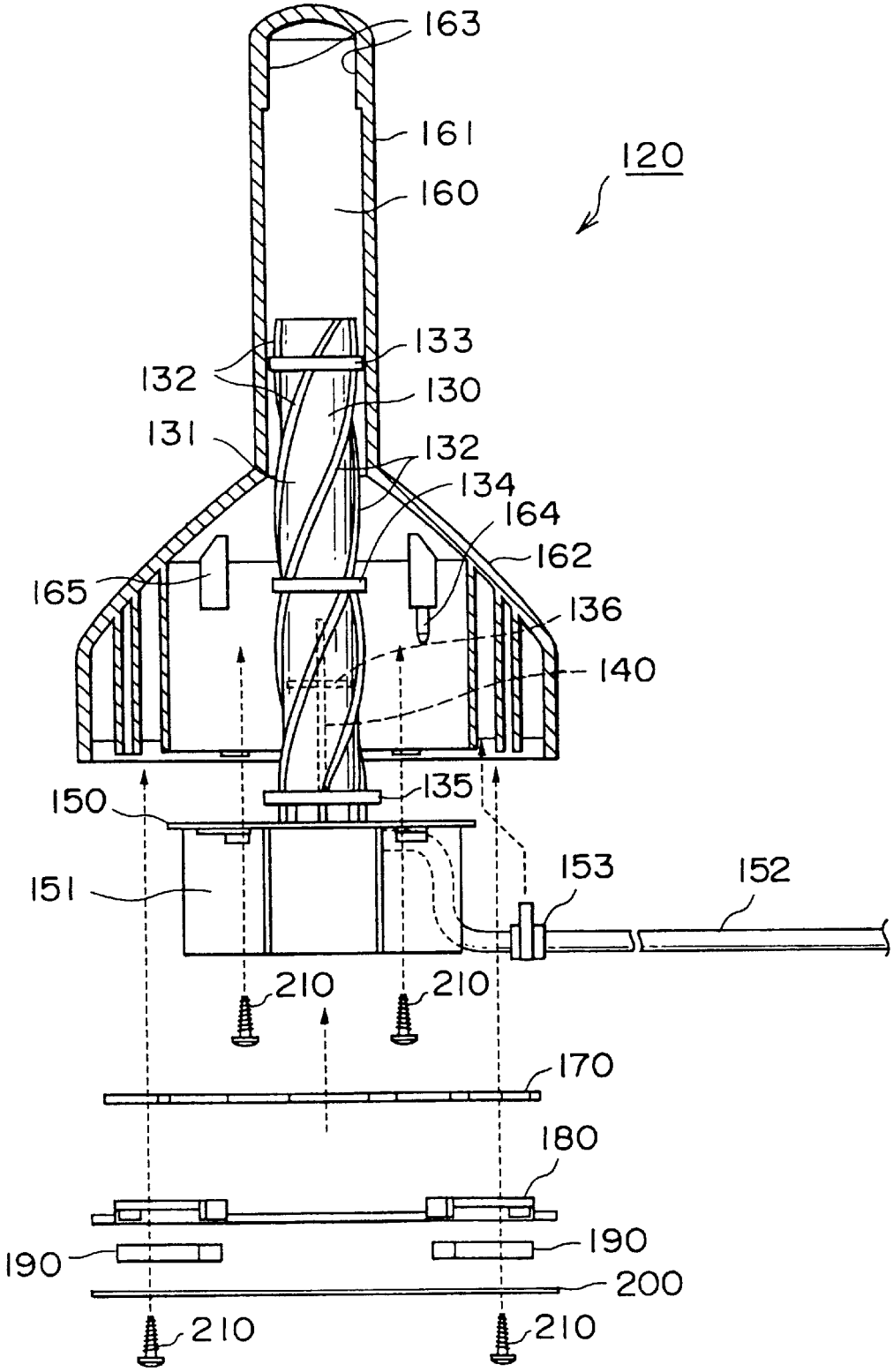
FIG. 12 is a partially-sectional exploded view of an antenna apparatus according to a fourth embodiment of this invention.

Referring to FIG. 12, the antenna apparatus 120 comprises a helical antenna 130, a monopole antenna 140 accommodated inside the helical antenna 130, a phase shifter substrate 150 to which the helical antenna 130 and the monopole antenna 140 are fixed, and a top cover 160 covering the helical antenna 130 (and the monopole antenna 140) and the phase shifter substrate 150. The antenna apparatus 120 further comprises a rubber packing 170, a bottom cover 180, four magnets 190, a label (PET sheet) 200, and a plurality of screws 210.

The helical antenna 130 comprises a cylindrical bobbin 131, four copper wires 132 wound around the bobbin 131, and wire holders 133, 134, and 135 for positioning and fixing the copper wires 132 to the bobbin 131.

Each of the cylindrical bobbin 131 and the wire holders 133, 134, and 135 is made of an insulating material, for example, an insulating resin material. The cylindrical bobbin 131 has an outer diameter of about 12 mm. Each of the wire holders 133 and 134 has an inner diameter substantially equal to the outer diameter of the cylindrical bobbin 131. As a consequence, when fitted to the bobbin 131, the wire holders 133 and 134 are fixed or secured to the cylindrical bobbin 131 under the frictional force caused therebetween. On the other hand, the wire holder 135 is integrally formed with the cylindrical bobbin 131.

The cylindrical bobbin 131 has at least one monopole antenna holder 136 arranged inside.

Figure 13A:
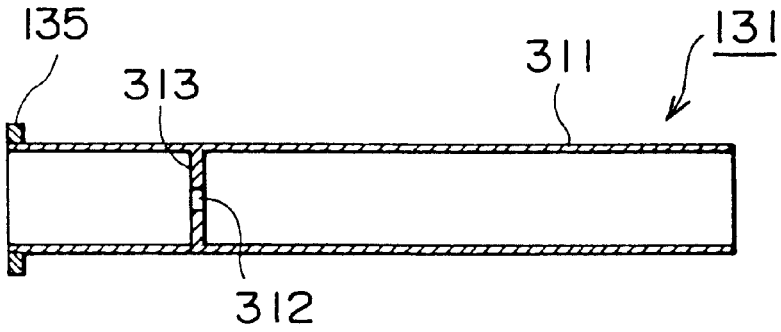
FIG. 13A is a vertical sectional view of an insulating cylindrical member used in the antenna apparatus illustrated in FIG. 12.
Figure 13B:
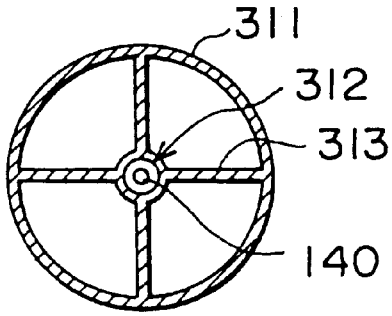
FIG. 13B is a horizontal sectional view of the insulating cylindrical member used in the antenna apparatus illustrated in FIG. 12.

Referring to FIGS. 13A and 13B, the cylindrical bobbin 131 comprises an outer cylindrical member 311, a hollow center member 312, and four ribs 313 connecting the outer cylindrical member 311 and the hollow center member 312 to each other. The outer cylindrical member 311, the center member 312, and the ribs 313 are formed by integral molding together with the wire holder 135. The ribs 313 extend from the center member 312 radially outward to reach an inner peripheral surface of the outer cylindrical member 311. A combination of the center member 312 and the ribs 313 serves as the monopole antenna holder 136 for supporting or holding the monopole antenna 140.

Figure 14A:
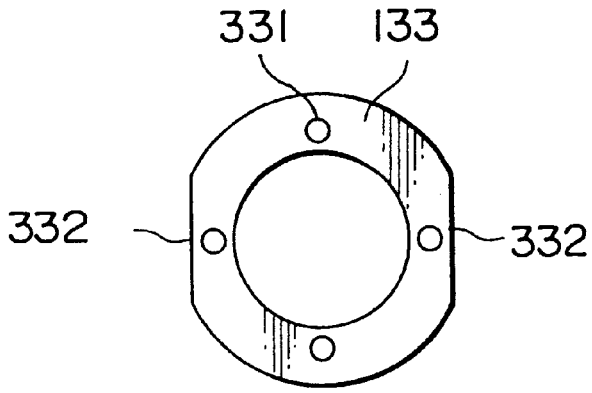
FIG. 14A is a plan view of an uppermost one of ring-shaped insulating wire holders used in the antenna apparatus illustrated in FIG. 12.
Figure 14B:
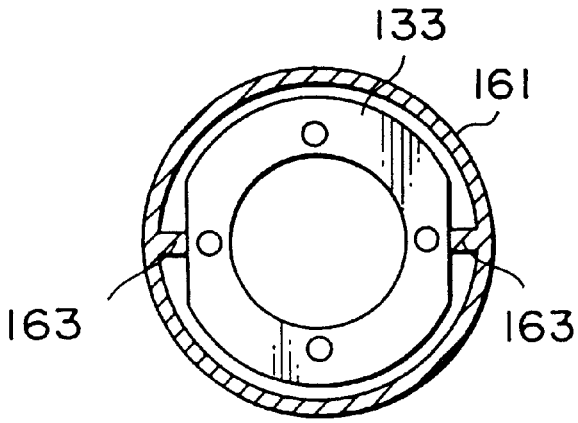
FIG. 14B is a horizontal sectional view of the antenna apparatus illustrated in FIG. 12 at a part in the vicinity of its end.

As illustrated in FIG. 14A, the wire holder 133 has notches or through holes 331 for engaging or inserting the copper wires 132. Likewise, the wire holders 134 and 135 have notches or through holes for engaging or inserting the copper wires 132.

Turning back to FIG. 12, the four copper wires 132 are arranged around the bobbin 131 at equal intervals in its circumferential direction and are wound around the bobbin 131 at equal pitches. For example, each of the copper wires 132 has a diameter of about 1 mm.

The monopole antenna 140 is held by the monopole antenna holder 136 formed inside of the cylindrical bobbin 131 so that a center axis of the monopole antenna 140 coincides with that of the bobbin 131.

The phase shifter substrate 150 is a circuit board with a low-noise amplifier (not shown) mounted on its lower surface and a shield cover 151 attached thereto. The helical antenna 130 is fixed to an upper surface of the phase shifter substrate 150 together with the monopole antenna 140 and is electrically connected to the low-noise amplifier. The low-noise amplifier is connected to a cable 152. To the cable 152, a bushing 153 is attached to fix the cable 152 to a top cover 160.

The top cover 160 has a cylindrical portion 161 accommodating the helical antenna 130 and a skirt portion or a conical portion 162 accommodating the phase shifter substrate 150 and so on.

Figure 15:
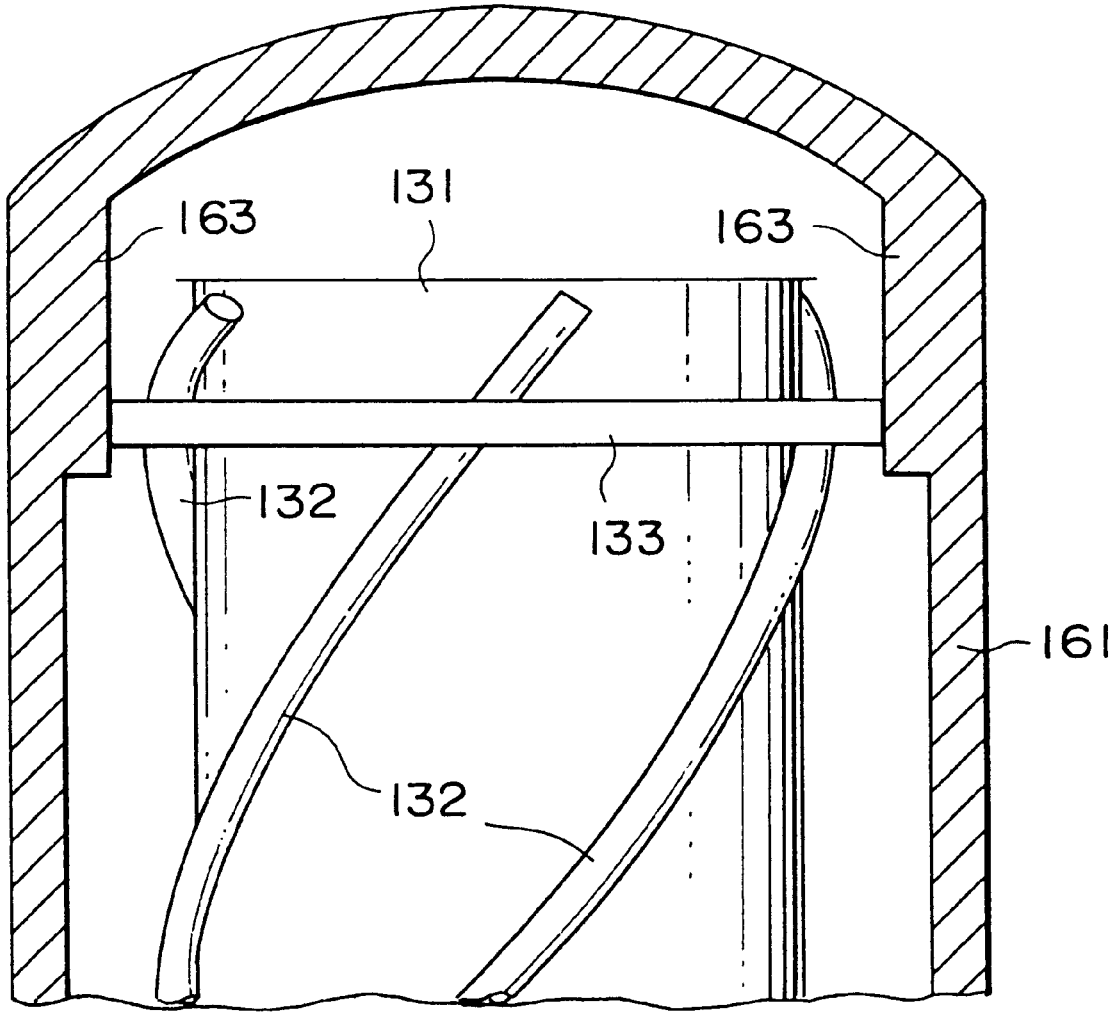
FIG. 15 is a partially-sectional enlarged view of the antenna apparatus illustrated in FIG. 12 at another part in the vicinity of its center portion.

The cylindrical portion 161 has a plurality of protrusions 163 formed on its inner peripheral surface in the vicinity of its end so as to prevent the rotation of the wire holder 133 in the circumferential direction. As illustrated in FIG. 14A, the wire holder 133 has an outer periphery formed in the shape partially cut away (i.e., the shape having cut portions 332). As illustrated in FIG. 148, the protrusions 163 are formed to correspond to the cut portions 332. Therefore; the protrusions 163 do not inhibit the helical antenna 130 from advancing towards the end of the cylindrical portion 161 and, when the helical antenna 130 advances to a predetermined position, engage the cut portions 332 of the wire holder 133, as illustrated in FIG. 15. Thus, the rotation of the wire holder 133 in the circumferential direction is inhibited by the protrusions 163.

Turning back to FIG. 12 again, the conical portion 162 is provided with a pin 164 for positioning the phase shifter substrate 150 and a projecting portion 165 for supporting and fixing the phase shifter substrate 150.

An antenna assembly comprising the helical antenna 130 and the monopole antenna 140 fixed to the phase shifter substrate 150 is inserted into the top cover 160 until the end of the helical antenna 130 reaches the neighborhood of the end of the cylindrical portion 161 of the top cover 160 and the phase shifter substrate 150 is brought into contact with the projecting portion 165. After the helical antenna 130 is covered with the top cover 160 as described above, the phase shifter substrate 150 is fixed to the top cover 160 by the use of screws 210.

Furthermore, a rubber packing 170, a bottom cover 180, a magnet 190, and a label 200 are fixed by screws 210 to a lower end of the top cover 160.

As described above, in the above-mentioned antenna apparatus, the protrusions 163 formed in the cylindrical portion 161 of the top cover 160 inhibits the rotation of the wire holder 133 in the circumferential direction. Therefore, even if the antenna apparatus is mounted on a vehicle or the like and used in a situation where it is continuously subjected to vibration, the wire holder 133 is prevented from being rotated to unwind the wires 132. Since the wire holder 135 is integrally formed with the bobbin 131, the bobbin 131 is prevented from being rotated together with the wire holders 133 and 134 to unwind the wires 132. Furthermore, the antenna apparatus requires no substantial increase in cost and manhour upon assembling.

Since the monopole antenna holder is integrally formed with the cylindrical bobbin, the number of components is reduced and the production process is simplified. Furthermore, the monopole antenna is stable in directional characteristics.

In this embodiment, the protrusions 163 extend in a lengthwise direction of the top cover 160. Alternatively, the protrusions 163 may be formed only at a position corresponding to the wire holder 133. Alternatively, the protrusions 163 may extend further downward so as to inhibit the rotation of the wire holder 134 also.

In this embodiment, each of the protrusions 163 has a generally square shape in section. Alternatively, the protrusions 163 may have a sectional shape formed by cutting away a part of a circle in correspondence to the shape of the cut portion 332 (i.e., the shape of the inner periphery of the cylindrical portion 161 is analogous to the shape of the outer periphery of the wire holder 133).

In the foregoing embodiment, the protrusions 163 are formed so as to engage the cut portions 332 preliminarily formed in the wire holder 133. Alternatively, the wire holder 133 may be provided with notches or recesses for inhibiting the rotation while the top cover 160 is provided with protrusions to be engaged therewith. In this case, the recesses may be formed in an upper surface of the wire holder 133 and the protrusions may be formed at corresponding positions of the top cover 160 to be engaged therewith.

In the foregoing embodiment, the top cover 160 has the cylindrical portion 161. Alternatively, the top cover 160 may have a generally conical shape as illustrated in FIG. 11. In this case, the protrusions may be replaced by a projecting pin (or a projecting plate, a projecting cylindrical portion) formed on the inner surface of the top cover. At any rate, the rotation of the wire holder is inhibited in the manner similar to the foregoing embodiment.

In the foregoing embodiment, the single monopole antenna holder 136 is formed. Alternatively, a plurality of monopole antenna holders may be formed. Alternatively, the monopole antenna holder may be long in the lengthwise direction of the cylindrical bobbin 131 (for example, extends from one end to the other end).

In the foregoing embodiment, the number of ribs 313 is equal to four. Alternatively, the number of the ribs 313 may be any number not smaller than three.

Next, description will be made of an antenna apparatus according to a fifth embodiment of this invention. The antenna apparatus is similar to the antenna apparatus of FIG. 12 except for the phase shifter substrate 150 and the cable 152.

The antenna apparatus of this embodiment has another phase shifter substrate (not shown) which does not have the combiner (43 in FIG. 4). Accordingly, the antenna apparatus comprises a twin cable for individually connecting the helical antenna 130 and the monopole antenna 140 to the receiver body.

Figure 16A:
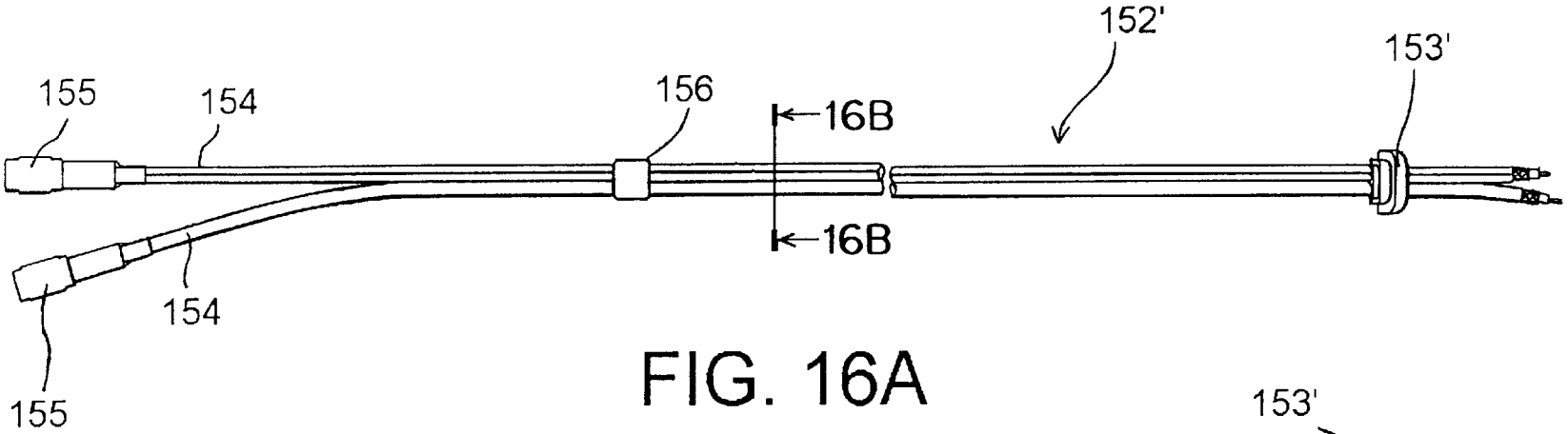
FIGS. 16A, 16B, and 16C show a twin cable used in an antenna apparatus according to a fifth embodiment of this invention.
Figure 16C:
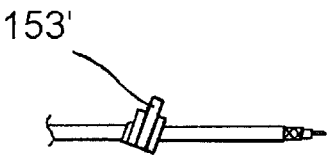
Figure 16B:
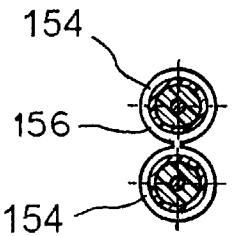

As illustrated in FIGS. 16A and 16B, the twin cable 152' has a pair of cables 154 which are united with each other. A cable bushing 153' is attached to the twin cable 152' near one end of the twin cable 152' as shown in FIGS. 16A and 16C. The cable bushing 153' is used to fix the twin cable 152' to the top cover 160. At the other end of the twin cable 152', connectors 155 are connected to the cables 154 as illustrated in FIG. 16A. The connectors 155 are connected to other connectors (not shown) mounted to the receiver body. A split prevention bushing 156 is attached to the twin cable 152' to prevent the cables 154 from being separated from each other.

Figure 17:
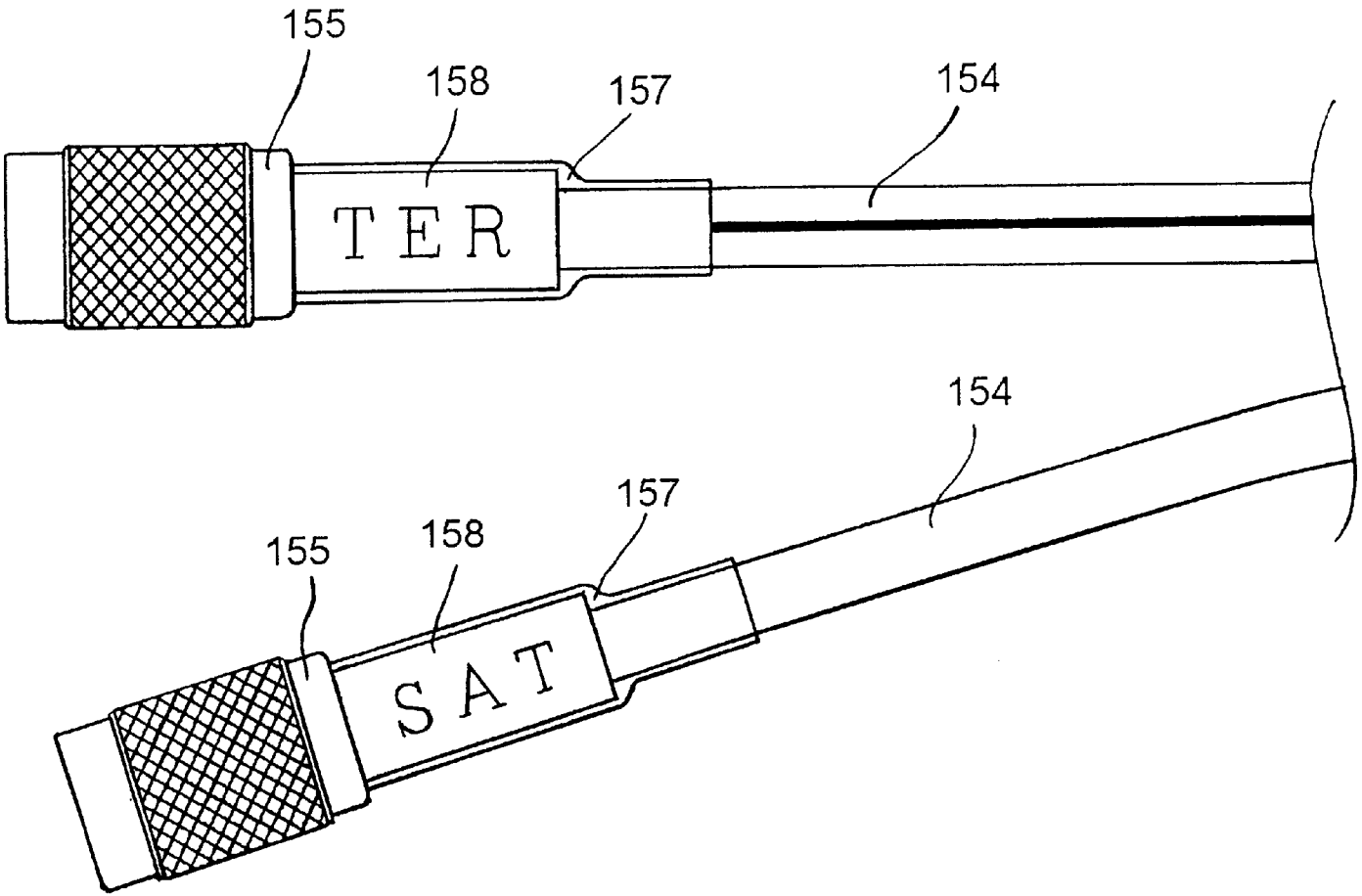
FIG. 17 is an enlarged view showing a part of the twin cable illustrated in FIG. 16A.

Referring to FIG. 17, the connectors 155 have transparent heat-shrinkable tubes 157. The transparent heat-shrinkable tubes 157 cover tags 158 which are partially inserted in sleeves of the connectors 155. Each tag shows that each connector 155 corresponds to either the helical antenna 130 or the monopole antenna 140. The tags 158 may be stickers which are stuck onto the cables 154. Furthermore, the transparent heat-shrinkable tubes 157 may be colored in different colors.

What is claimed is:

1. An antenna apparatus comprising:

a plurality of antennas for receiving, as reception signals, radio waves different from one another in frequency;

a single case or substrate to which said antennas are mounted; and a single cable for transmitting to a receiver body a combined reception signal obtained by combining said reception signals received by said antennas;

wherein said case or said substrate is provided with a plurality of low-noise amplifiers corresponding to said antennas, respectively.

2. An antenna apparatus as claimed in claim 1, wherein said case or said substrate is provided with shield covers corresponding to said antennas, respectively.

3. An antenna apparatus as claimed in claim 1, wherein said case or said substrate is provided with a shield cover in common to said antennas.

4. An antenna apparatus as claimed in claim 1, further comprising a top cover -covering all of said antennas.

5. An antenna apparatus as claimed in claim 1, wherein one of said antennas is a helical antenna.

6. An antenna apparatus as claimed in claim 5, wherein said helical antenna comprises:

an insulating cylindrical bobbin;

a wire member helically wound around an outer peripheral surface of said cylindrical bobbin; and a plurality of ring-shaped insulating wire holders fitted to said cylindrical bobbin to fix said wire member to said cylindrical bobbin.

7. An antenna apparatus as claimed in claim 6, wherein said wire member comprises a plurality of wires.

8. An antenna apparatus as claimed in claim 6, wherein each of said wire holders has a notch for engaging said wire member.

9. An antenna apparatus as claimed in claim 6, wherein at least an uppermost one of said wire holders is fixed in position with respect to said cylindrical bobbin under frictional force.

10. An antenna apparatus as claimed in claim 9, further comprising a top cover covering all of said antennas, said uppermost wire holder having a recess or a cut formed at its outer periphery, wherein:

said top cover has a protrusion to be engaged with said recess or said cut to inhibit rotation of said uppermost wire holder in a circumferential direction.

11. An antenna apparatus as claimed in claim 10, wherein at least a part of said top cover where said helical antenna is accommodated has a cylindrical shape, said protrusion being formed on an inner peripheral surface of said cylindrical shape to extend in a lengthwise direction.

12. An antenna apparatus as claimed in claim 6, wherein a lowermost one of said wire holders is integrally formed with said bobbin.

13. An antenna apparatus as claimed in claim 1, wherein:

each of said antennas has a boss pin formed at its lower end;

said boss pin being inserted into a hole formed in said case or said substrate and fused to said case or said substrate.

14. An antenna apparatus as claimed in claim 1, wherein:

said antennas include a helical antenna and a monopole antenna;

said helical antenna comprises a cylindrical bobbin; and said monopole antenna is arranged inside said cylindrical bobbin.

15. An antenna apparatus as claimed in claim 14, wherein said cylindrical bobbin comprises:

an outer cylindrical member;

a hollow center member having a center axis coincident with a center axis of said outer cylindrical member, said monopole antenna being inserted in said hollow center member; and three or more ribs radially extending from said center member to said outer cylindrical member to connect said center member and said outer cylindrical member to each other;

said outer cylindrical member, said center member, and said rib being integrally formed with one another.

16. An antenna apparatus as claimed in claim 15, wherein each of said outer cylindrical member, said center member, and said rib is made of a resin material.

17. An antenna apparatus as claimed in claim 15, wherein said center member extends from one end to another end of said outer cylindrical member.

18. An antenna apparatus as claimed in claim 15, wherein said center member is shorter in length than said outer cylindrical member.

19. A method of producing an antenna apparatus comprising a helical antenna, said method comprising the steps of:

arranging a plurality of wires on an outer peripheral surface of an insulating cylindrical member in its lengthwise direction;

fitting a ring-shaped insulating wire holder to said insulating cylindrical member so as to hold said wire; and rotating said ring-shaped insulating wire holder in a circumferential direction of said insulating cylindrical member by a predetermined angle.

20. A method of producing an antenna apparatus comprising an antenna, said method comprising the steps of:

inserting a boss pin formed at a lower end of said antenna into a hole formed in a substrate; and heating said boss pin to fuse said boss pin to said substrate.

* * * * *